US005772533A

United States Patent [19]

Dahlmann

[11] Patent Number: 5,772,533

[45] Date of Patent: Jun. 30, 1998

[54] GOLF TEE SETTER BALL TEEING DEVICE

[76] Inventor: T. Lee Dahlmann, 18333 Carriage Dr., Morgan HIll, Calif. 95037

[21] Appl. No.: 779,303

[22] Filed: Jan. 6, 1997

[51] Int. Cl.[6] ..... A63B 57/00

[52] U.S. Cl. ..... 473/386

[58] Field of Search ..... 473/386

[56] References Cited

U.S. PATENT DOCUMENTS

| | | | |
|---|---|---|---|
| 2,609,198 | 8/1952 | Armstrong | 273/32 |
| 2,801,875 | 2/1957 | McEvoy | 294/19 |
| 2,819,109 | 6/1958 | Borah | 294/19 |
| 2,833,584 | 2/1958 | McEvoy | 294/19 |
| 3,540,727 | 11/1970 | Hoe | 473/86 |
| 3,870,300 | 3/1975 | Amendola | 273/32 B |
| 3,889,946 | 6/1975 | Setecka | 473/86 |
| 4,313,604 | 2/1982 | Baxter | 473/86 |
| 4,526,369 | 7/1985 | Phelps | 273/32 B |
| 4,616,826 | 10/1986 | Trefts | 273/32.5 |
| 4,714,250 | 12/1987 | Henthorn | 273/32.5 |
| 4,819,938 | 4/1989 | Hill | 273/32.5 |
| 4,905,999 | 3/1990 | Voinovich | 473/86 |
| 4,949,961 | 8/1990 | Milano | 273/32.5 |
| 4,951,947 | 8/1990 | Kopfle | 473/86 |
| 4,969,646 | 11/1990 | Tobias | 273/32.5 |
| 5,012,872 | 5/1991 | Cohn | 172/380 |
| 5,080,357 | 1/1992 | Wolf | 273/32.5 |
| 5,094,456 | 3/1992 | Mitchell | 273/162 B |
| 5,171,010 | 12/1992 | Lanoue | 473/86 |
| 5,205,598 | 4/1993 | Miller | 294/19.2 |
| 5,330,177 | 7/1994 | Rogge | 273/32.5 |
| 5,330,178 | 7/1994 | Gelshert | 273/32.5 |
| 5,439,213 | 8/1995 | Pimentel | 273/32.5 |
| 5,499,813 | 3/1996 | Black | 273/32.5 |
| 5,503,394 | 4/1996 | Mavck et al. | 273/32.5 |

*Primary Examiner*—Theatrice Brown

[57] ABSTRACT

A small, lightweight golf ball teeing device is disclosed for allowing a golfer to tee up a golf ball without bending over using a golf club as a handle for the device. A housing positions the golf ball over the golf tee. A delayed urging means is used to clamp the ball and tee to the housing. While the tee is inserted into the ground, the delayed urging means compresses and rebounds slowly releasing the ball and tee from the device. Gripping fingers are positioned on top of the housing to provide a secure, aligned attachment to a golf club grip. An opening in the housing permits horizontal golf tees to be scooped up without bending. A clip is incorporated with the housing to provide attachment to golf bags, belts, etc.

11 Claims, 5 Drawing Sheets

GOLF TEE SETTER BALL TEEING DEVICE

BACKGROUND

1. Field of Invention

This invention relates to a golf ball teeing device that easily permits a golfer, without bending over, to insert a golf tee into the ground with a golf ball situated on top of the tee in preparation for driving the ball.

2. Description of Prior Art

Elderly golfers often find it difficult to bend over to place a golf tee in the ground and place a ball upon the tee. Additionally, golfers with back or knee problems have the same difficulty.

Inventors have described several devices that allow the tee and ball to be positioned without bending over. Some of these devices can also be used to retrieve the tee out of the ground once the ball has been hit. These devices all involve a mechanism that clamps the ball and tee to the device which is mounted to the end of a handle or pole long enough to preclude the user from having to bend over. At the held end of the pole is a control which is in communication with the clamping mechanism. This control permits the golfer to unclamp the tee and ball from the device once the tee has been inserted into the ground.

All of these devices are relatively elaborate and incorporate the use of several moving parts as exemplified by U.S. pat. Nos. 2,609,198 to Armstrong (1952), 4,526,369 to Phelps (1985), 4,616,826 to Trefts (1986), 4,714,250 to Henthorn (1987), 4,969,646 to Tobias (1988), 4,819,938 to Hill (1989), 4,949,961 to Milano (1990), 4,951,947 to Kopfle (1990), 5,080,357 to Wolf(1992), 5,171,010 to fanoue (1992), 5,205,598 to Miller (1993), 5,330,177 to Rogge (1994), 5,330,178 to Geishert (1994), 5,439,213 to Pimentel (1995), 5,499,813 to Black (1996), and 5,503,394 to Mauck and Shelton (1996).

No inventor known to me has been able to eliminate the need for the golfer to manually unclamp the ball and tee from the device. Therefore, the prior devices all require a long handle with an unclamping control mounted to the end of the handle. Furthermore, they require some sort of mechanical linkage between the control and the clamping mechanism at the other end. This causes the following significant disadvantages common to all prior ball teeing devices:

(a) The long handle and elaborate mechanisms incorporated in these devices weigh too much to be comfortably carried by a golfer as an accessory to golf clubs.

(b) The elaborate nature of these devices make them too large to be carried in a golf bag in addition to golf clubs.

(c) The number of parts required causes the material and labor costs associated with producing these devices to be inefficient with regard to bringing these devices to the buying public.

(d) The large. elaborate nature of these devices causes them to be visually unappealing as a golf accessory prohibiting their commercial success in the marketplace.

In addition to the above disadvantages, the use of such devices is cumbersome, time consuming, and inefficient. Using these devices to tee up a ball and to retrieve the tee without bending over requires four trips to the golf bag as the golfer alternates between the device and his club. Some inventors have attempted to minimize this by incorporating the use of a sharp member to anchor the device to the ground in an upright position while the golfer uses the club. This allows the device and club to be transported to and from the golf bag together instead of alternately as described in U.S. pat. Nos. 4,951,947 to Kopfle (1990), 5,439,213 to Pimentel (1995), 5,499,813 to Black (1996), and 5,503,394 to Mauck and Shelton (1996). However, this requires the golfer to operate the large heavy device one-handed while holding the golf club in the other hand to keep from bending over. Additionally, the sharp anchor can be a safety hazard to the golfer.

With regard to other golf related inventions, inventors have described small light weight devices which can be temporarily attached to the end of a golf club to accomplish different tasks. For example U.S. pat. Nos. 2,801,875 to McEvoy (1957), 2,819,109 to Borah (1958), and 2,833,584 to McEvoy (1958) describe devices which are attached to the grip end of a golf club for use as golf ball retrievers.

Similarly, U.S. pat. Nos. 3.870,300 to Amendola (1975), 5,012,872 to Cohn (1991), and 5,094,456 to Mitchell (1992) describe devices which are attached to the grip end of a golf club to serve as sand trap rakes. These devices utilize a golf club as the handle making the devices themselves small, lightweight, and portable.

However, no other inventor has devised a tee and ball placing device which eliminates the need for an unclamping control incorporated into a long pole thereby allowing a golf club to be used as the handle. The teeing devices listed above all require the user to manually release the tee and ball by actuating some sort of control linkage incorporated into a long pole.

OBJECTS AND ADVANTAGES

Accordingly. several objects and advantages of my invention are:

(a) to provide a golf ball teeing device which can operate without a manually controlled unclamping mechanism integral with the device;

(b) to provide a golf ball teeing device which can utilize a golf club as a handle;

(c) to provide a golf ball teeing device which contains relatively few parts making the device lightweight;

(d) to provide a golf ball teeing device which is small, portable, and does not require a substantial amount of space in a golf bag;

(e) to provide a golf ball teeing device which can be quickly and easily used without requiring the cumbersome juggling of a large device and a golf club;

(f) to provide a golf ball teeing device which can also be used to retrieve the golf tee once the ball has been hit for both instances of the tee laying horizontally on the ground or remaining vertically inserted into the ground.

Further objects and advantages will become apparent from a consideration of the ensuing description and drawings.

Figure 1:
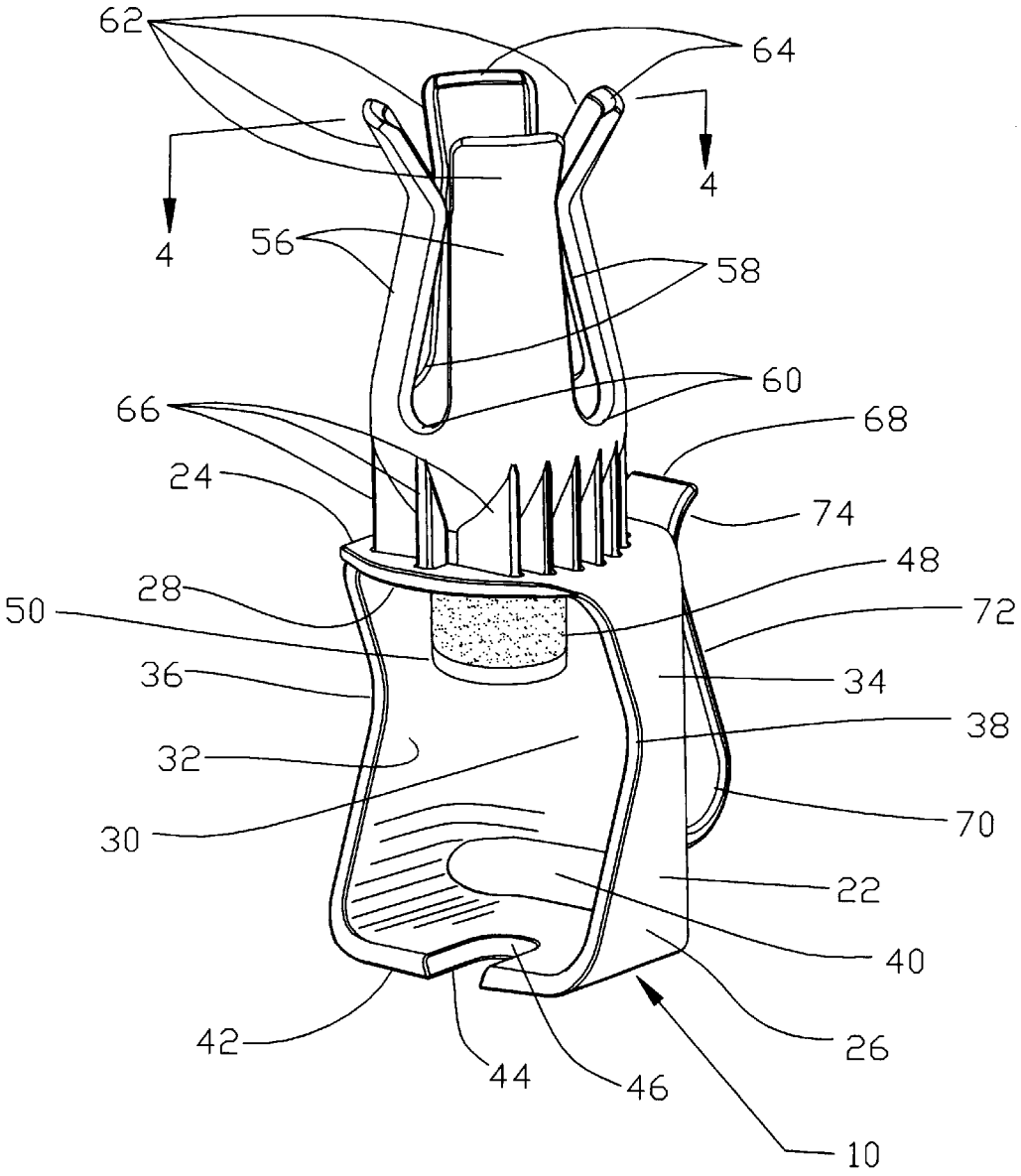
FIG. 1 is an isometric illustration of the front of a specific illustrative embodiment.

| Reference Numerals In Drawings | |
|---|---|
| 10 teeing device | 12 golf ball |
| 14 golf tee | 16 head of golf tee |
| 18 shank of golf tee | 20 golf club grip |
| 22 housing | 24 upper housing |
| 26 lower housing | 28 top wall |
| 30 rear wall | 32 left vertical wall |
| 34 right vertical wall | 36 left recess |
| 38 right recess | 40 opening |
| 42 bottom wall | 44 slot |
| 46 rounded end | 48 delayed urging means |
| 50 interface member | 52 annular wall |
| 54 taper | 56 gripping fingers |
| 58 voids | 60 rounded bottoms |
| 62 outward flares | 64 chamfered edges |
| 66 supporting ribs | 68 clip |
| 70 radius | 72 inward bend |
| 74 outward bend | |

DESCRIPTION OF THE PREFERRED EMBODIMENT

THE entire device is referred to generally by the reference numeral 10. A golf ball is referred to generally by the reference numeral 12. A golf tee is referred to generally by the reference numeral 14, having a head 16, and a shank 18. A golf club grip is referred to generally by the reference numeral 20.

The perferred embodiment of the present invention is illustrated in FIG. 1. The invention comprises a housing 22, which includes an upper portion 24, and a lower portion 26. The upper portion 24 includes a top wall 28, a rear wall 30, left vertical side wall 32, and a right vertical side wall 34. Side walls 32 and 34 incorporate a recessed portion 36 and 38 respectively to facilitate easy removal of the device 10 from the teed golf ball 12. The lower end of the rear wall 30 contains an opening 40 that extends between the two side walls 32 and 34. The opening 40 has a height that will permit passage of the golf tee shank 18 but will not allow passage of the golf tee head 16 and is used to facilitate the retrieval of the golf tee 14 lying horizontally on the ground. The lower portion 26 of the housing 22 includes a bottom wall 42 which contains a slot 44 that extends inward from the edge of the bottom wall 42. The slot 44 terminates with a rounded end 46. The entire wall of the slot 44 is angled such that the slot is larger on the top surface of the bottom wall 42 than the bottom surface of the bottom wall 42. The edges of the housing 22 are typically chamfered or rounded to avoid snagging or personal injury.

Attached to the lower surface of the top wall 28 is a delayed urging means 48 which exhibits a delayed rebound after being compressed. Examples of such delayed urging means 48 are the ISODAMP® C-3000 series of energy absorbing foams manufactured by E-A-R Division, Cabot Corporation, Indianapolis, Ind. These foams rebound very slowly after being compressed. In the preferred embodiment, a cylindrical piece of E-A-R C-3002-50 low-recovery foam is used. However, means other than low-recovery foam could be used to provide a delayed urging function. The delayed urging means 48 is typically fastened to the top wall 28 by means of an adhesive. The placement of the delayed urging means 48 on the underside of the top wall 28 is such that it will be directly over the golf ball 12 when placed in the housing 22.

Figure 3:
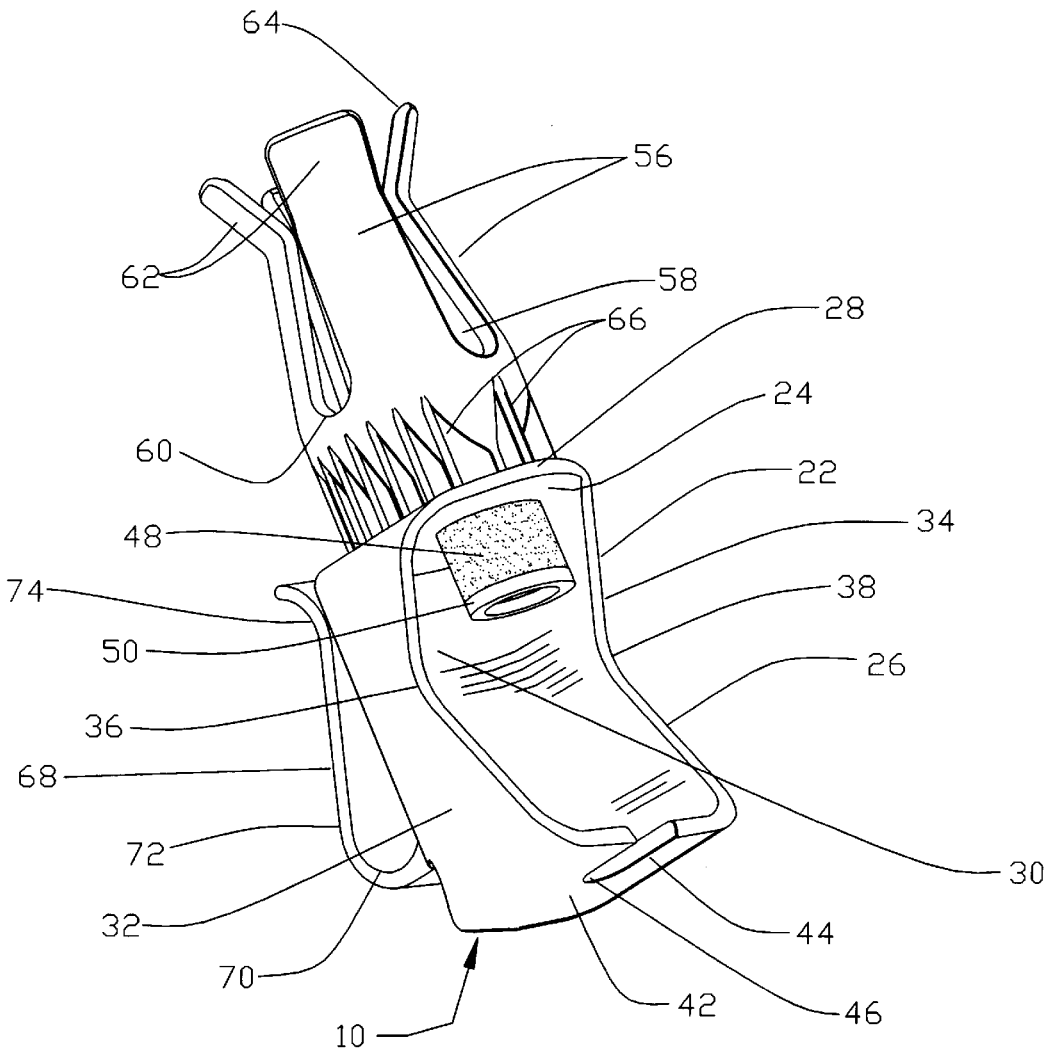
FIG. 3 is an isometric illustration of a specific illustrative embodiment from another angle.

Attached to the bottom of the delayed urging means 48 is a rigid ball interface member 50 used to provide a uniform surface to contact the golf ball 12. In the preferred embodiment, this member is a ring shaped object with an outer diameter equal to the delayed urging means 48 diameter and an inner diameter sufficiently large enough to provide engagement of the golf ball 12. However interface members of other shapes would equally suffice. The interface member 50 is typically attached to the delayed urging means 48 by means of an adhesive. FIG. 3 shows a better view of the interface member 50.

The housing 22 height, interface member 50 size, slot 44 dimensions, and delayed urging means 48 size all affect the performance of the device 10. This combination of dimensions must be such that when the golf ball 12 is placed in the housing 22 below the interface member 50 and the golf tee 14 is slid into the slot underneath the ball 12, the delayed urging means 48 is slightly compressed exerting enough of a downward force to securely hold the ball 12 and tee 14 into the device 10. Additionally, these dimensions must be such that the delayed urging means 48 sufficiently further compresses due to the upward force on the tee 14 when the device 10 is used to insert the tee 14 into the ground. In the preferred embodiment, the interior height of housing 22 is 2.24 inches, slot 44 is 0.36 inches wide with angled walls at 21°, the interface member height is 0.12 inches with an inner diameter of 0.64 inches, and the delayed urging means 48 has a diameter of 0.75 inches and a height of 0.50 inches in its uncompressed state. These dimensions describe one possible embodiment of the invention. Other combinations of dimension values could also be used to achieve successful operation of the device 10.

Figure 4:
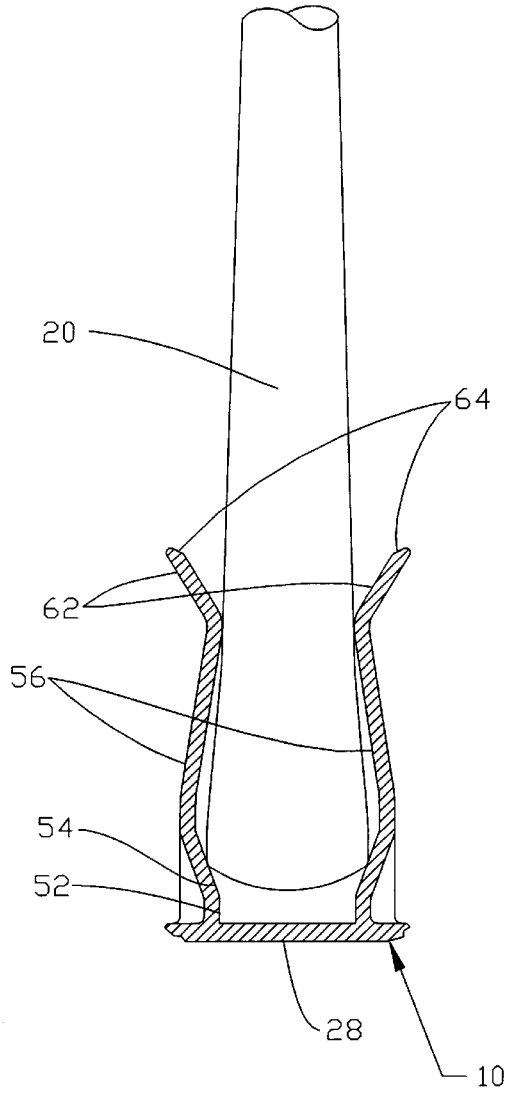
FIG. 4 is a partial sectional view taken along line 4—4 of FIG. 1 showing a golf club grip inserted into the preferred embodiment.

Extending from the upper side of the top wall 28 is the portion used to attach the device 10 to a golf club grip 20 as shown in FIG. 4. From the top wall 28, an annular wall 52 extends upward vertically and then flares outward becoming a taper 54. The annular wall 52 provides clearance for the end of the golf club grip 20 which is often convex in shape. The taper 54 ensures that the device 10 is aligned with the axis of the golf club by centering the end of the golf club grip 20. The diameters at the bottom and top of the taper 54 are sized to accommodate the full range of golf club grip 20 diameters available in the market place. Above the taper 54 the wall angles inward forming a plurality of individual gripping fingers 56 capable of flexing outward. In the preferred embodiment four gripping fingers 56 are used; however, any number greater or equal to two would work. FIG. 1 shows how the gripping fingers 56 are separated from each other by voids 58. The voids 58 incorporate rounded bottoms 60 to reduce stress concentrations in the flexing material. The gripping fingers 56 are of sufficient height to prevent the device 10 from becoming skewed with respect to the axis of the golf club. FIG. 4 shows how the gripping fingers 56 incorporate outward flares 62 at the top to provide easy insertion of the golf club grip 20. The very top of the gripping fingers 56 incorporate chamfered edges 64 to also aid in the insertion of the golf club grip 20.

FIG. 1 shows a series of supporting ribs 66 used to provide strength to the annular wall 52 and to the taper 54 below the gripping fingers 56. These ribs 66 ensure that the stress created in the material during insertion of a golf club grip 20 will not cause a fracture in the material.

Figure 2:
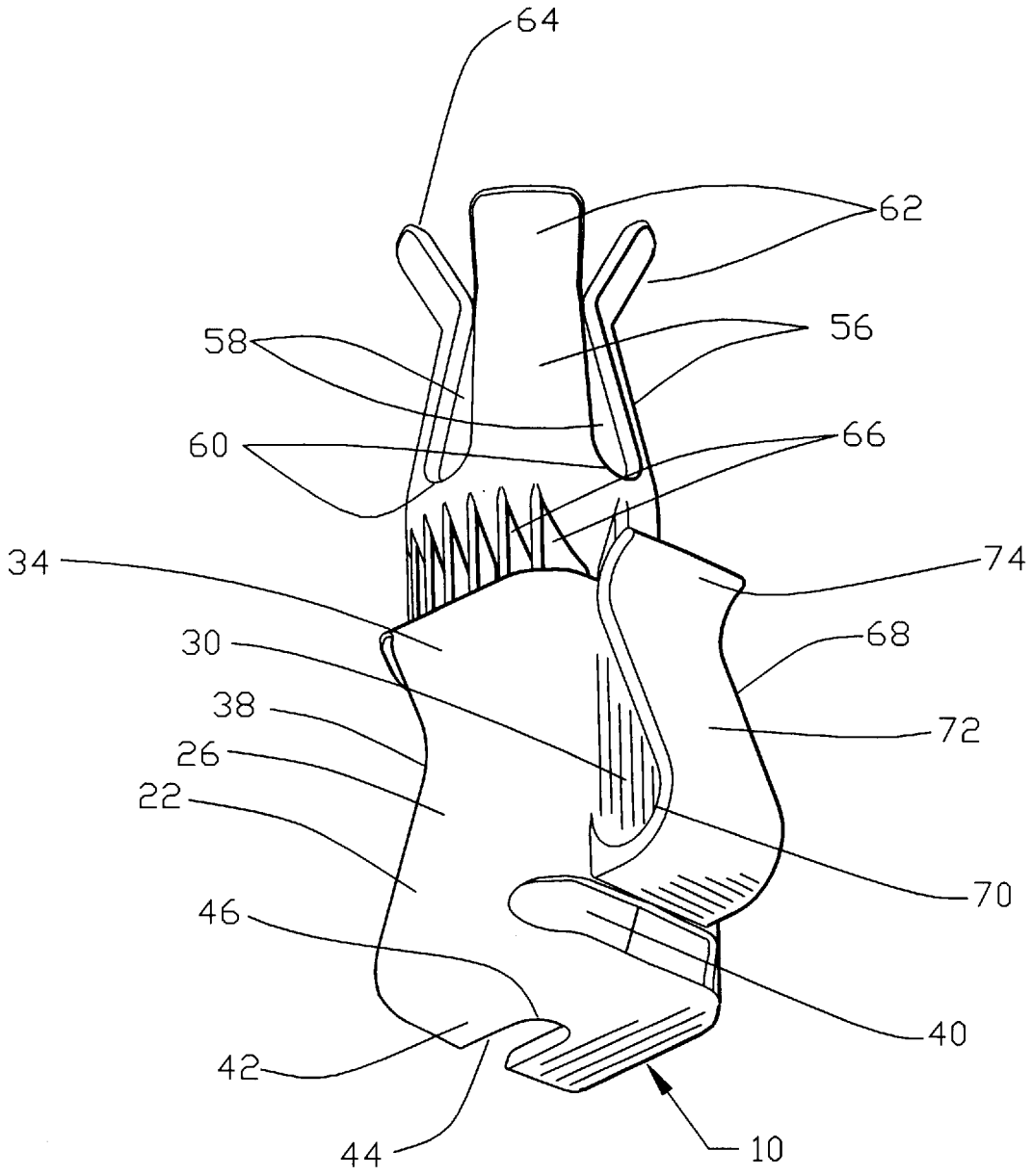
FIG. 2 is an isometric illustration of the rear of a specific illustrative embodiment.

FIG. 2 shows a clip 68 extending from the rear of the housing 22 just above the opening 40. The clip 68 is shaped with a large enough radius 70 to permit the device 10 to be clipped to the side of a typical golf bag. The clip 68 incorporates an inward bend 72 towards the housing 22 permitting the device 10 to be securely clipped to the pocket of a golfer's clothing. An outward bend 74 at the top of the clip 68 allows the device 10 to be easily clipped to a golf bag, pocket, or belt.

In the preferred embodiment the entire device 10, except delayed urging means 48, is molded from an economical, flexible plastic material such as ABS. However, the device 10 can consist of any other material that exhibits the elasticity and impact resistance characteristics suitable for the application.

From the description above, a number of advantages of the present invention become evident:

(a) The device automatically unclamps the ball and tee once the tee is pushed into the ground since the delayed urging means becomes further compressed and will not immediately rebound.

(b) The golfer can use a golf club as the device handle since no handle mounted unclamping control is needed.

(c) The device makes it possible to tee up a golf ball from a standing position without the cumbersome use of relatively very large prior mechanisms.

(d) The device allows a golfer to tee up golf balls without bending over by only carrying a small, lightweight device during a golf outing.

(e) The device can be used to retrieve golf tees from the ground even if they are in a horizontal orientation.

Figure 5A:
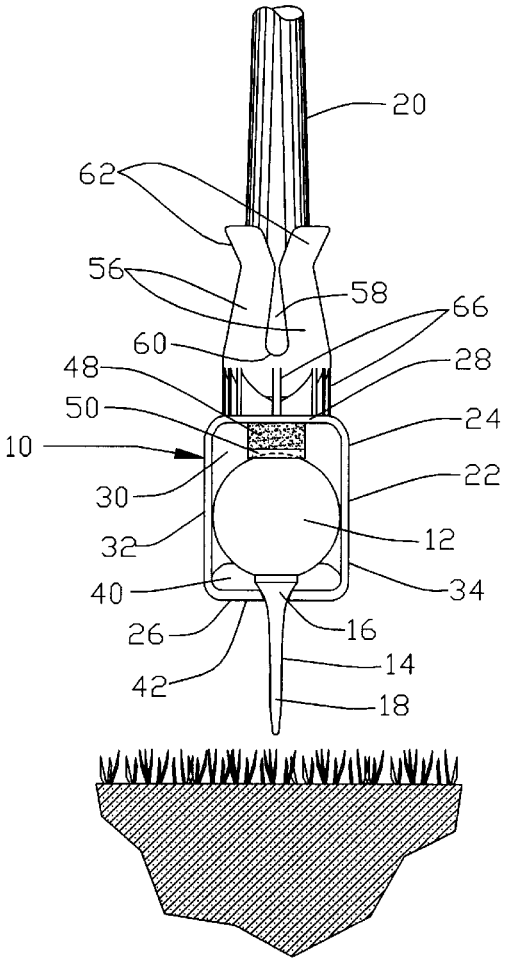
FIG. 5A is a front view showing a specific illustrative embodiment prior to inserting the tee into the ground with the ball and tee being clamped together.
Figure 5B:
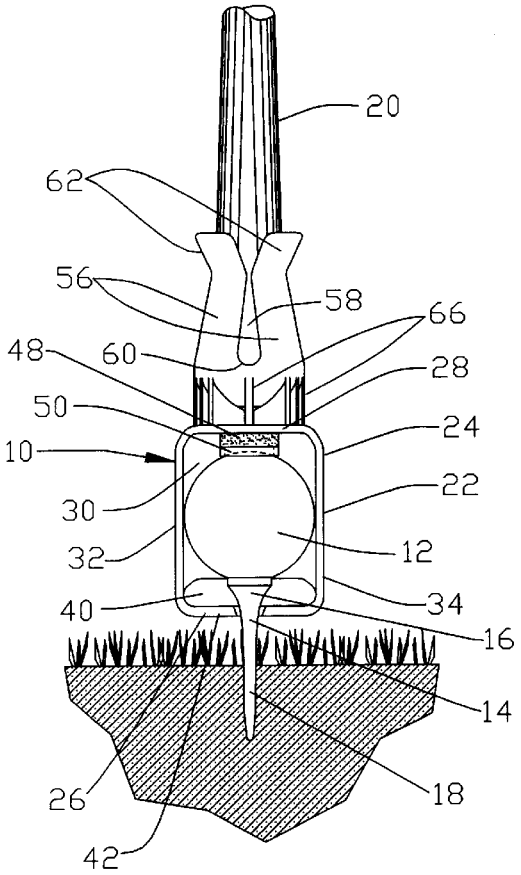
FIG. 5B is a front view showing a specific illustrative embodiment as the tee is inserted into the ground.
Figure 5C:
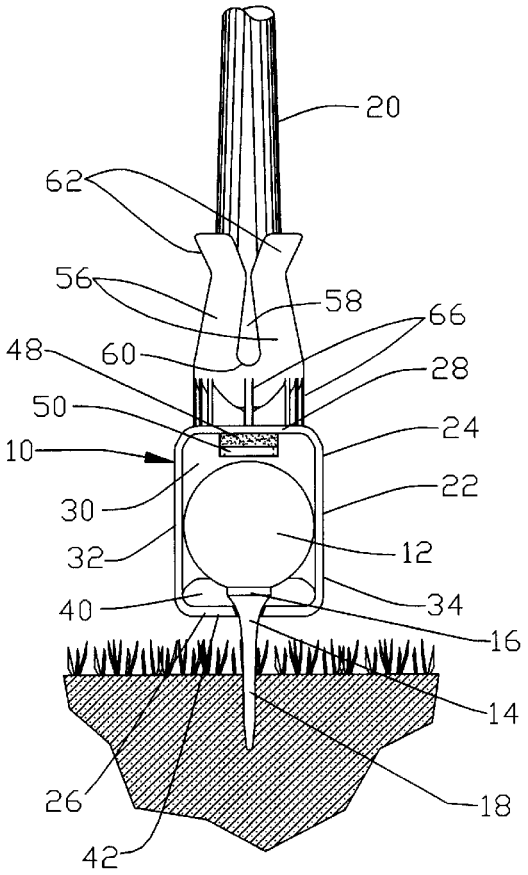
FIG. 5C is a front view showing a specific illustrative embodiment ready to release the tee and ball which are no longer clamped to the device.

Operation-FIGS. 5A, 5B, 5C

In use, the golfer removes the desired golf club from the golf bag and then unclips the device 10 from the golf bag, a pocket, a belt, or wherever the device 10 is stored. The device 10 is then attached to the golf club by pushing the gripping fingers 56 fully onto the end of the golf club grip 20 until the end of grip 20 comes in contact with the taper 54. A golf ball 12 is then placed in the housing 22 below the ball interface member 50. A golf tee 14 is then slid into slot 44 causing the ball 12 to push against the interface member 50 somewhat compressing the delayed urging means 48. The delayed urging means 48 exerts a downward force on the ball 12 clamping the ball 12 and tee 14 securely to the device 10 as shown in FIG. 5A The golf club is then held by the golfer at the club head end with the grip end towards the ground. The golf club is positioned in a vertical orientation with the shaft of the golf club perpendicular to the ground. The golfer holds the golf club at a height such that the tip of the golf tee 14 is a short distance above the ground as also shown in FIG. 5A. The golfer then moves the golf club straight down sinking the golf tee 14 into the ground. As the tee 14 enters the ground it exerts an upward force on the ball 12 causing the delayed urging means 48 to substantially compress. As this happens, the device 10 lowers with respect to the ball 12 and tee 14 such that the slot 44 is no longer in full contact with the underside of the tee head 16 as shown in FIG. 5B. Once the golf tee 14 has been sunk to the desired depth into the ground, the golfer releases the ball 12 and tee 14 from the device 10 by slightly moving the golf club straight up until the interface member 50 no longer is in contact with the ball as shown in FIG. 5C. The delayed urging means 48 remains compressed for a period of several seconds allowing the device 10 to be laterally removed from the teed ball 12 by moving the golf club in a motion parallel to the ground.

After teeing up the ball 12, the golfer then pulls the device 10 off the end of the golf club and uses clip 68 to temporarily fasten the device 10 to a pocket or belt while the ball 12 is hit. The device 10 can then be reinstalled on the golf club grip 20 to be used to retrieve the golf tee 14 without bending over. For instances when the tee 14 remains in the ground while hitting the ball 12, the golfer uses the golf club as a long handle and maneuvers slot 44 of the device 10 under the head 16 of the tee 14. The tee 14 can then be pulled out of the ground and retrieved without bending. For instances when the tee 14 comes out of the ground while hitting the ball 12 and is lying horizontally on the ground, the golfer again uses the golf club as a long handle and retrieves the tee 14 using the device 10. This is accomplished by maneuvering the bottom wall 42 of housing 22 underneath the shank 18 of the tee such that the tip of the tee 14 protrudes through opening 40 of the housing 22. The opening 40 will not permit passage of the tee head 16 allowing the tee 14 to be scooped up without bending.

Accordingly, this invention allows a golfer to easily tee up a golf ball without bending over. In addition, the invention permits a golfer to easily retrieve a golf tee without bending over whether or not the tee came out of the ground while hitting the ball. Furthermore, the teeing device has the additional advantages in that it permits a golf club to be utilized as the handle reducing the weight and size of the device;

it is very simple to use with no cumbersome controls to release the tee and ball;

it can easily and nonintrusively be clipped onto a golfer's apparel while hitting the ball;

it can easily be attached to a golf bag;

it can be made from far fewer parts than prior tee setting devices.

Although the description above contains many specifics, these should not be construed as limiting the scope of the invention but as merely providing illustrations of some of the presently preferred embodiments of this invention. For example, a means other than low-recovery foam could be used to provide a delayed urging means. Furthermore, the dimensions given of the housing, interface member, low-recovery material, and slot could be different, the ball interface member could be eliminated; the gripping fingers could be of a different shape, the clip could be shaped differently, the supporting ribs could be eliminated, etc.

Thus the scope of the invention should be determined by the appended claims and their legal equivalents, rather than by the examples given.

I claim:

1. A golf aid for inserting a golf tee into the ground with a golf ball situated on top of the tee, comprising:

a delayed urging means exhibiting a delayed rebound once compressed;

means for supporting said delayed urging means between a grip end of a golf club shaft and said golf ball; and means for supporting said golf tee underneath said golf ball such that said golf tee is in contact with said golf ball.

2. The golf aid of claim 1 wherein said delayed urging means is a body of low-recovery foam.

3. The golf aid of claim 1 further including an interface member attached to said delayed urging means for making uniform contact with the golf ball.

4. A golf aid for inserting a golf tee having a tee head and having a tee shank into the ground with a golf ball situated on top of the tee, comprising:

(a) a housing having means at a lower portion thereof for supporting the golf tee and having means at an upper portion thereof for positioning the golf ball above the head of said golf tee;

(b) a delayed urging means attached to the upper portion of said housing such that the golf ball is urged against the head of the golf tee wherein said delayed urging means exhibits a delayed rebound after being further compressed; and (c) means for attaching said housing to a golf club grip.

5. The golf aid of claim 4 wherein said delayed urging means is a body of low-recovery foam.

6. The golf aid of claim 4 further including an interface member attached to said delayed urging means for making contact with the golf ball.

7. The golf aid of claim 4 further including means for temporarily attaching said golf aid to an other article.

8. The golf aid of claim 4 further including an opening in the lower portion of housing, said opening being large enough to permit passage of the tee shank and small enough to prevent passage of the tee head whereby a golf tee lying horizontally on the ground can be scooped up.

9. A method for placing a golf tee in the ground with a golf ball situated on top of said golf tee, comprising the steps of:

(a) clamping the golf ball to the golf tee by use of a delayed urging means coupled with a housing, wherein said delayed urging means exhibits a delayed rebound after it is further compressed;

(b) inserting the golf tee into the ground causing said delayed urging means to compress; and (c) removing the housing from the teed golf ball while the delayed urging means remains compressed.

10. The method of claim 9 wherein the step of inserting includes the step of attaching the housing to a grip end of a golf club.

11. The method of claim 10 and further comprising scooping up a horizontally lying golf tee wherein scooping involves maneuvering an opening around a shank of the golf tee until a tee head is caught by said opening.

* * * * *